United States Patent [19]

Ryan et al.

[11] 4,200,287

[45] * Apr. 29, 1980

[54] REMOTELY CONTROLLED MINIATURE VEHICLE

[75] Inventors: John W. Ryan, Los Angeles; James D. Moore, Palos Verdes, both of Calif.

[73] Assignee: Ideal Toy Corporation, Hollis, N.Y.

[ * ] Notice: The portion of the term of this patent subsequent to Feb. 27, 1996, has been disclaimed.

[21] Appl. No.: 878,474

[22] Filed: Feb. 16, 1978

Related U.S. Application Data

[63] Continuation-in-part of Ser. No. 781,546, Mar. 28, 1977, abandoned, which is a continuation-in-part of Ser. No. 632,471, Nov. 17, 1975, abandoned.

[51] Int. Cl.[2] ..... A63F 9/14; A63H 18/12; A63H 17/36

[52] U.S. Cl. ..... 273/86 B; 46/262; 104/60; 104/304

[58] Field of Search ..... 273/86 B; 46/258, 259, 46/260, 261, 262; 104/60, 149

[56] References Cited

U.S. PATENT DOCUMENTS

| | | | |
|---|---|---|---|
| 1,660,715 | 2/1928 | Lingenfelder | 273/86 B |
| 2,109,403 | 2/1938 | Roussy et al. | 104/60 |
| 2,784,527 | 3/1957 | Sarff | 273/86 R UX |
| 2,925,875 | 2/1960 | Bourdon | 180/79.2 |
| 3,077,165 | 2/1963 | Vittorelli | 104/247 |
| 3,239,963 | 3/1966 | Smith et al. | 46/255 |
| 3,246,719 | 4/1966 | Lahr | 180/79.1 |
| 3,307,292 | 3/1967 | Fileger | 46/257 |
| 3,324,366 | 6/1967 | Ryan | 46/258 X |
| 3,453,970 | 7/1969 | Hansen | 273/86 B |
| 3,774,340 | 11/1973 | Barlow et al. | 273/86 B X |
| 3,813,812 | 6/1974 | Barlow et al. | 273/86 B X |
| 4,078,799 | 3/1978 | Lahr | 273/86 B |

FOREIGN PATENT DOCUMENTS

| | | | |
|---|---|---|---|
| 582698 | 9/1959 | Canada | 46/262 |
| 1039899 | 9/1958 | Fed. Rep. of Germany | 46/262 |

*Primary Examiner*—Anton O. Oechsle
*Attorney, Agent, or Firm*—Richard M. Rabkin

[57] ABSTRACT

An improved remotely controlled miniature vehicle, more particularly an electrically driven miniature car of the type operated on a track-way having contact strips through which power is supplied to the driving motor of the vehicle. Improved remote control is provided for controlling the miniature car for changing one lane to another. The front wheels are steerable by actuation of a steering post. The driving motor is mounted to move physically in response to additional driving torque applied through a gear train to the rear wheels. Mechanism is provided whereby the physical movement of the driving motor actuates the steering mechanism to turn the front wheels for changing from one lane to another. Provided in one form of the invention is a member having rollers that can contact a side wall of the track for positioning the front wheels and steering post to pre-determine the direction of turning in response to physical movement of the driving motor.

23 Claims, 18 Drawing Figures

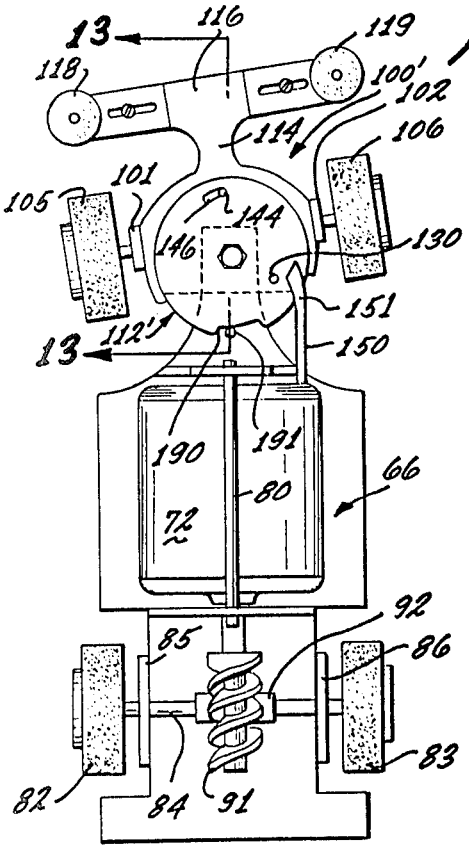
FIG. 12
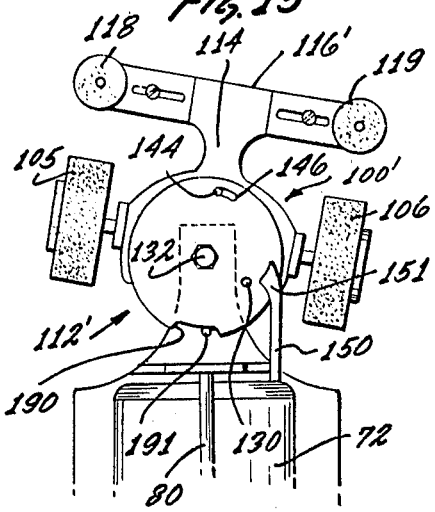
FIG. 15
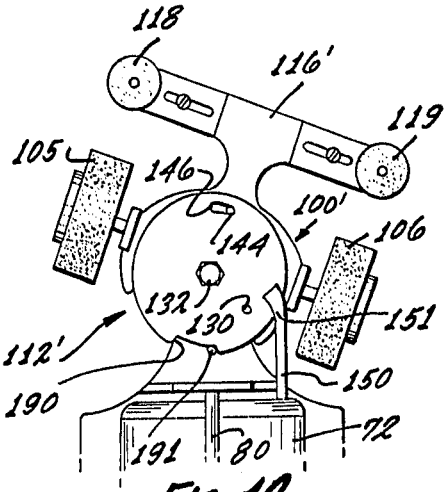
FIG. 14
FIG. 13
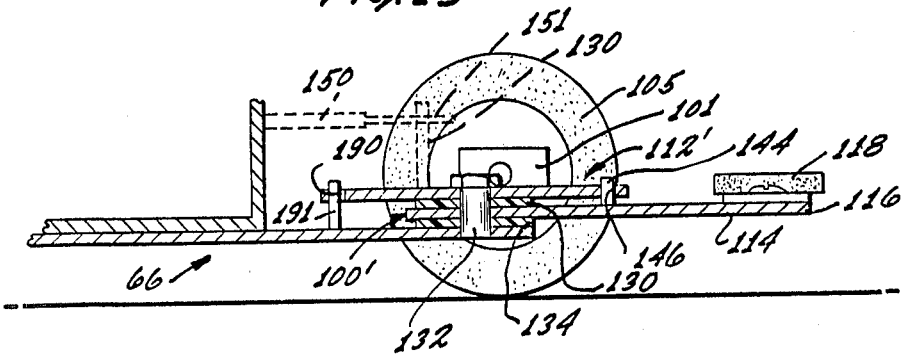

REMOTELY CONTROLLED MINIATURE VEHICLE

This application is a continuation-in-part of U.S. patent application Ser. No. 781,546 filed Mar. 28, 1977, now abandoned, which is a continuation-in-part of U.S. patent application Ser. No. 632,471 filed Nov. 17, 1975, now abandoned. The disclosures of said applications are incorporated herein by reference as if fully set forth herein.

BACKGROUND OF THE INVENTION

1. Field of the Invention

The field of the invention is that of remotely controlled electrically driven minature toy vehicles and more particularly miniature cars that are operated on a closed track way having contact strips through which power is supplied to the vehicle through brushes or collectors carried by the vehicle. The nature of the improvements is described more in detail hereinafter.

2. Description of the Prior Art

Remotely controlled miniature vehicles particularly cars are known in the art. Typically a conventional type of remote control vehicle is provided as part of a remote controlled system wherein the vehicles operate on a track having contact strips through which the power is supplied, the vehicles being adapted for remote steering control whereby they are able to pass one another and change from one lane to another. Certain categories of vehicles are known as "slot cars" and in this particular category of system the vehicles are constrained directionally by virtue of slots or guides to follow a particular pre-determined path. However, that type of system wherein the vehicle travels on a flat track with flush contact strips and is steerable remotely, whereby it can pass other vehicles and can transfer from one lane to another is more realistic. An exemplary form of this type of system and vehicle is disclosed in U.S. Pat. No. 3,774,340. This system, as known, however, leaves room for improvements. In this type of prior art system, the vehicle is controlled remotely by control of the voltage, that is power supplied to the electric driving motor of the vehicle which drives the rear wheels through gear train. The motor moves physically relative to the chassis, being actuated by inertia, that is momentum upon change in voltage supplied in response to remote control. The steering means includes steerable front wheels which can be turned in one direction or the other for causing the car to transfer from one lane to the other of two lanes provided in a track way with side walls which can be engaged by a front wheel of the vehicle for positioning the front wheel steering means in a position to be activated by movement of the driving motor for turning the wheels in a manner to cause the vehicle to change lanes. In this category of system, the steering mechanism is relatively complex; it depends upon the steerable front wheel having engagement with the side wall of the track, and it depends upon the physical fore and aft movement of the propelling motor. Thus, these constructions leave room for improvements in the way of simplified, less complex and more dependably operable mechanisms. The herein invention as described in detail hereinafter seeks to overcome all of the shortcomings of the prior art and otherwise to achieve the purposes of the particular objectives as set forth hereinafter.

SUMMARY OF THE INVENTION

The remote steering control of the vehicle of the herein invention is achieved by way of changes in current supplied to the driving motor. The driving motor is mounted to provide for physical movement in response to variation in torque applied to the worm gear of the driving train that drives the rear wheels. The motor may move angularly about an axis above or below it or about its own axis, this movement being imparted to the steering mechanism for turning the front wheels to cause the vehicle to transfer from one lane to another.

Further improvements reside in the steering mechanism itself. The front axle is mounted to turn about a vertical axis. The steering means carries a vertical steering post which is offset from the center of the axle so that upon its being moved forwardly or rearwardly, the front wheels are turned. A steering stem member is carried by the motor and is movable by the motor to engage the steering post to turn the front wheels one way or another depending upon the position of the steering post at the time of engagement by the steering stem member. In one form of the invention pre-positioning of the steering post is achieved by way of a positioning member which is rotatable relative to the vehicle chassis about a vertical axis, the positioning member carrying rollers engageable with the track side walls and the positioning member being connected to the front axle through a lost motion connection for pre-positioning the steering post to thereby predetermine the direction that the front wheels will be turned upon actuation by movement by the driving motor.

In a simplified form of the invention as described hereinafter, the front axle has only two positions. It occupies one position or the other for turning and travelling along a lane. Impulses from the drive motor position it in one position or the other.

In the light of the foregoing, the primary object of the invention is to provide an improved miniature remote electrically controlled vehicle wherein the remote control is provided by way of a driving motor which drives the vehicle wheels through a gear train and is mounted for movement in response to a change in driving torque with means whereby the motor movement actuates steerable wheels.

A further object is to provide means for realizing the steerable impulse in response to a changing current wherein the motor is mounted to move angularly about an axis spaced from the axis of the motor or alternatively moves angularly about its own axis.

A further object is to provide improved steering mechanism wherein the front axle is turnable about a vertical axis and a vertical steering post is provided which is offset laterally and which is movable fore and aft for turning the front wheels in one direction or the other, the steering post being movable by a steering member that is actuated by movement of the motor itself in response to a variation in torque of the driving motor.

Further objects reside in advancing the state of the art by achieving proportionally realistic acceleration and deceleration of the vehicle as the speed is changed by the operator. This may be achieved in part by way of the motor having a fly wheel. A corollary object is to realize a greater range of speed control and to achieve control by way of current change rather than voltage change. A further object is to realize a system wherein controllable cars and non-controlable traffic vehicles are intermixed with the capability of the control cars being able to overtake traffic cars that they can pass or slow down to avoid collisions.

In preferred forms of the invention the track layouts are oval or FIG. 8 with simplified means for converting from one to the other. A further object is to provide a track which is foldable for easy storage, and instant erection and readiness for operation without the typical assembly requirements.

Further objects and additional advantages of the invention will become apparent from the following detailed description and annex drawings.

BRIEF DESCRIPTION OF THE DRAWING

FIG. 12 is a plan view of another modified form of remotely controlled vehicle;

FIG. 13 is a sectional view taken along line 13—13 of FIG. 12;

FIGS. 14 and 15 are partial diagramatic views illustrating the remote steering control of the vehicle illustrated in FIGS. 12-13;

DESCRIPTION OF THE PREFERRED EMBODIMENTS

Figure 1:
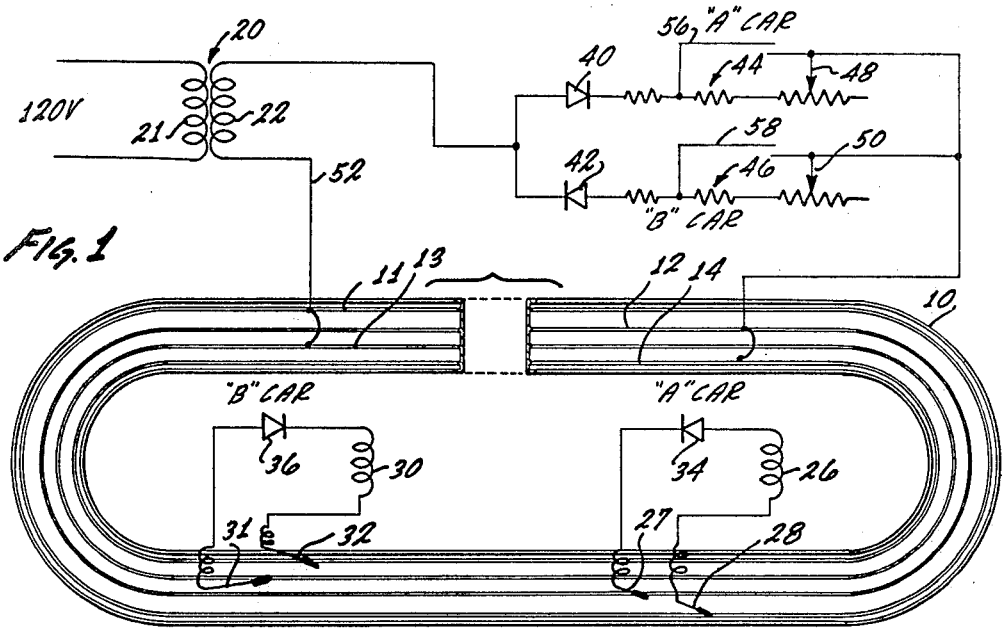
FIG. 1 is a schematic view of an exemplary form of oval track and electrical circuit arrangements for individually controlling two miniature vehicles.

FIG. 1 shows schematically an oval track 10 having side walls which corresponds generally to types of track known in the prior art. The track is provided with embedded flush contact strips as designated at 11 and 12, providing a pathway to be followed adjacent one side of the track and numerals 13 and 14 designate another pair of flush contact strips providing another pathway adjacent the other side of the track. The remotely controlled vehicles are able to transfer from one pathway to the other, that is, from one side of the track to the other.

The vehicles as will be described, are provided with pairs of brushes or collectors that engage the flush contact strips whereby power is supplied to the driving motors of the cars.

In the exemplary arrangement shown, circuitry is provided for providing power to two cars having electric driving motors identified as the A and B cars. Power is supplied through a transformer as designated at 20 having a primary winding 21 and a secondary winding 22 and providing appropriate voltage for the circuitry. The circuitry of the individual driving motors of the cars A and B is illustrated within the oval track 10. The A car has a motor winding designated at 26, which receives power through brushes 27 and 28 engagable with the flush contact strips. The car B has motor winding 30 which receives power through the brushes or collectors 31 and 32. In the circuits of the motor windings 26 and 30 are the reversly connected diodes 34 and 36 so that the windings operate on opposite polarities of the applied voltage.

The circuitry of FIG. 1 is arranged to apply voltage of one polarity to one car and of the opposite polarity to the other car. The circuitry includes the parallel reversely connected diodes 40 and 42 which are in circuit with potentiometers 44 and 46, which connect to rheostats 48 and 50 to the conductive strips. One of the strips of each pair, that is, 11 and 13 connect to the common wire 52. The control rheostats 48 and 50 connect to the other conductive strips of the two pairs, that is strips 12 and 14. Numerals 56 and 58 designate switches for the power supplies of the respective cars whereby the current provided can be substantially varied by closing the switch to shunt a part of the potentiometer and the controlling rheostat to thereby vary the torque provided by the driving motor. As can be seen, half of the AC power wave, that is a half of each polarity is provided to each of the cars so that individual control of each car through its respective controller is possible, whether the car is following one of the pathways of the track of the other.

FIGS. 2-5 illustrate an exemplary preferred form of a miniature vehicle. The vehicle is schematically shown in these figures. As shown, the vehicle has a chassis which is essentially a flat plate, as designated by the numeral 66, having a shape as shown. It has a narrowed extending front portion 67 as may be seen in FIG. 3 and cut outs at the rear part as designated at 68 and 69 at the positions of the rear driving wheels. The electrical driving motor is designated by the numeral 72 and the motor is suspended in a frame having a bottom part 74 resting on the chassis 66 and having end parts 75 and 76 having a shape as may be seen in FIG. 5. Secured to the top of the motor is a rod member 80, the ends of which are journalled in the end members 75 and 76 of the motor supporting frame so that the motor is suspended and can swing angularly about the axis of rod or stem 80.

The brushers or collectors may be conventional, and are not shown.

The vehicle has rear wheels 82 and 83 of suitable type carried on a rear axle 84 journalled in flanges 85 and 86 carried by the frame or chassis 66.

The motor has a drive shaft 90 on which is a worm gear 91 and it meshes with a pinion gear 92 on the rear axle 84. The shaft 90 passes through an opening 94 in the support member 76. The front end of the motor extends into an opening 95 in the support member 75. As previously explained the motor can swing laterally, that is angularly about the axis of the supporting stem or rod 80. Pinion gear 92 is suitably crowned, that is rounded in cross section to accommodate the angular bodily movement of the motor 72. The operation will be described more in detail presently.

The front wheels of the vehicle are steerable in response to the bodily movement of the motor 72 as will be described. The front steering assembly, is illustrated in the FIGS. 2-5. The front wheels are mounted on an axle plate member as designated at 100. This member has upstanding side portions 101 and 102 which carry the axles 103 and 104 of the front wheels 105 and 106. See FIG. 5. Numeral 112 designates a positioning member or yoke which cooperates with the front axle member 100 as will be described. Positioning member 112 has a circular part 113 which overlies the member 100 as shown and it has a forwardly extending neck 114 with a transversely extended part 116. The transversely extending part 116 carries strips at its ends on which are mounted roller wheels 118 and 119, these strips being adjustable inwardly and outwardly to adjustable positions which can be set by way of the screws 120 and 121. The rollers 118 and 119 as will be described more in detail presently, are engagable with the side walls of the track for positioning the past 116.

The positioning member 112 has upstanding from it a vertical steering post 130 which is in a position rearwardly of the axis of the front axle members 103 and 104. The member 100 and the positioning member 112 are pivotally secured together by means of the pivot post 132 as may be seen in FIGS. 5 with interposed washers 133 and 134. Washer 133 is in between the positioning member 116 and the member 100 and washer 134 is between the member 100 and the part 67 of the chassis 66. The positioning member 112 is normally biased into a position wherein its transverse part is normal to the chassis by means of the resilient biasing stem 140 which is attached at one end to the part 67 of the chassis and is attached at its other end to a bracket 141 extending downwardly from the positioning member 112.

The axle member 100 and the positioning member 112 are coupled together by way of a lost motion connection which includes a vertical pin 144 upstanding from the axle member 100 through an arcuate slot 146, in the positioning member 112. The exact manner of cooperation of these parts will be described in detail presently.

Attached to the underside of the motor 72 at one side is a forwardly extending dart stem 150, whose free end 151 is pointed at its inner side to define an apex **151*a* extending inwardly towards the vertical steering post 130. Apex 151*a* separates two slightly concave cam surfaces 151*b* and 151*c* which cooperate with steering post 130 to steer the vehicle's front wheels. As will be described more in detail presently, the motor, of course, applies torque through the worm gear 91 to the pinion gear 92 for driving the rear wheels of the vehicle. There is, of course, a reaction torque applied to the motor 72 such that it can move angularly about the axis of the supporting rod or stem 80. When this happens, the steering stem or dart 150 is moved angularly laterally so as to engage one of its cam surfaces with the vertical steering post 130** to impart steering movement to the front wheels as will be described in detail presently.

Figure 6:
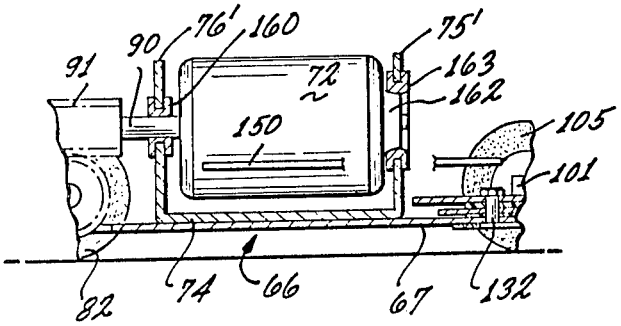
FIG. 6 is a partial sectional view of a modified form of the vehicle.

Before describing in detail the remote control steering operation of the vehicle, reference will be made to modified forms of motor suspension whereby the same or similar steering operation may be realized. One modified form of motor suspension or support is illustrated in FIG. 6 wherein the same reference numerals are used to identify the parts corresponding to the previous embodiment. In FIG. 6, the shaft 90 of motor 72 extends through a bearing 160 in support member 76'. At the other end of the motor 72, there is a boss 162 which is journalled in an annular bearing member 163 provided in the support member 75'. As may be seen, the frame of the motor itself is mounted so as to be able to rotate, that is move angularly. Thus, the reaction of the torque applied by the worm gear 90 can cause the body of the motor to rotate angularly in the opposite direction.

Thus, as may be seen, when the motor rotates about its axis, the dart stem 150 is moved correspondingly and it can engage the vertical steering post 130 to effect steering in the same or similar manner.

Figure 5:
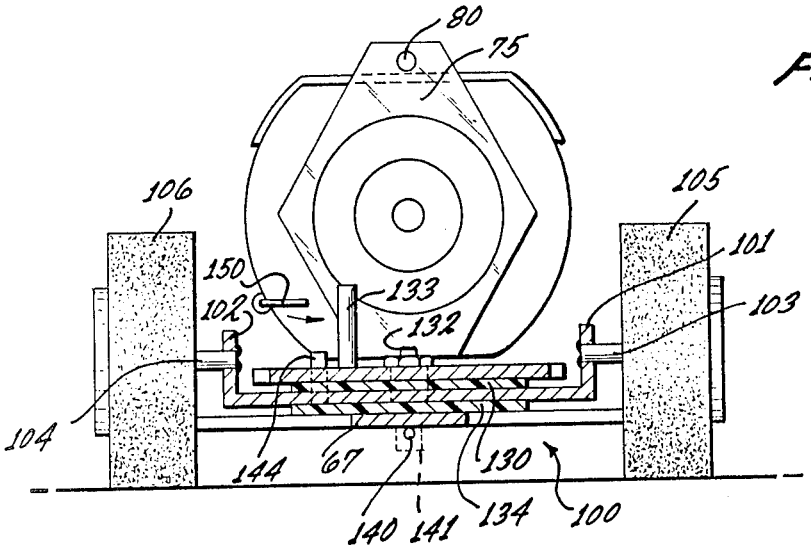
FIG. 5 is a sectional view taken along line 5—5 of FIG. 4.
Figure 7:
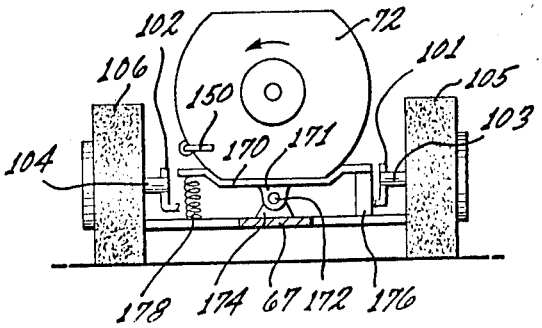
FIG. 7 is a schematic view of another form of the vehicle.

FIG. 7 is a schematic sectional view showing another form of the invention wherein the motor is mounted for bodily angular movement about an axis spaced below the axis of the motor as distinguished from the mounting illustrated in FIG. 5. In FIG. 7, the motor 72 is carried on a support plate 170 having brackets such as shown at 171 which are journalled on a stem 172 extending parallel to the chassis and supported by brackets like the one designated at 174. The support plate 170 is engagable at one side with a fixed stop 176 and is engagable at the other side with spring 178. In this form of the invention, the reaction torque as before, can cause the motor to move angularly about the axis 172 and past the dart stem 150 is movable similarly to bring about the steering operation.

From the foregoing, the similarity as well as the differences in the characteristics of the three forms of motor suspension are readily discernible. In each case, the reaction torque is, of course opposite to the direction of the driving torque. With the axis of suspension above the motor, the gear force which is the driving force between the gears acts with and assists the reaction torque in moving the motor for steering. With the motor mounted for angular movement about its own center line, or axis, the gear force produces minimal torque tending to rotate the motor. With the motor mounted about an axis, spaced below the motor axis, the reaction torque and gear force oppose each other.

OPERATION OF THE EMBODIMENTS OF FIGS. 1–5; FIG. 6 and FIG. 7

The operation is illustrated schematically in FIGS. 8, 9, 10 and 11. The steering results from bodily movement of the motor in response to changes in torque which move the steering stem or dart 150 with respect to the steering post 130. That is, when the operators desire to cause their vehicles to change lanes, they operate their respective switch to increase the voltage supplied to their respective vehicles. This increased voltage produces an increase in current supplied to the vehicle's motor. As is characteristic of electric power supplies the current will initially have a high value pulse and then the current level will drop back to a somewhat lower level than that of the pulse. This pulse of current produces an increase of torque by the motor causing it to pivot momentarily in its mounting. As the pulse of current drops off, the motor returns to its normal position. It is this instantaneous movement of the motor that is used for steering. This steering is essentially the same, irrespective of which of the disclosed types of mounting of the motor is used.

FIGS. 8–11 are schematic and exaggerated to illustrate the steering sequences.

Figure 8:
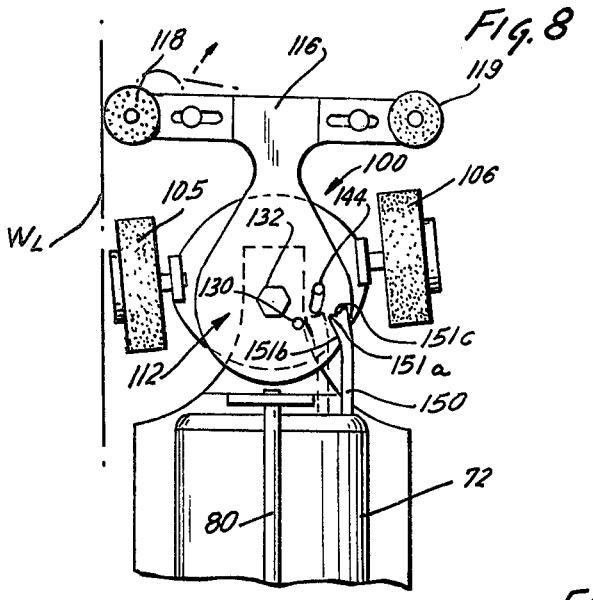
FIGS. 8, 9, 10 and 11 are partial diagramatic views illustrating the automatic steering under remote control of the vehicle illustrated in FIGS. 1-5.
Figure 10:
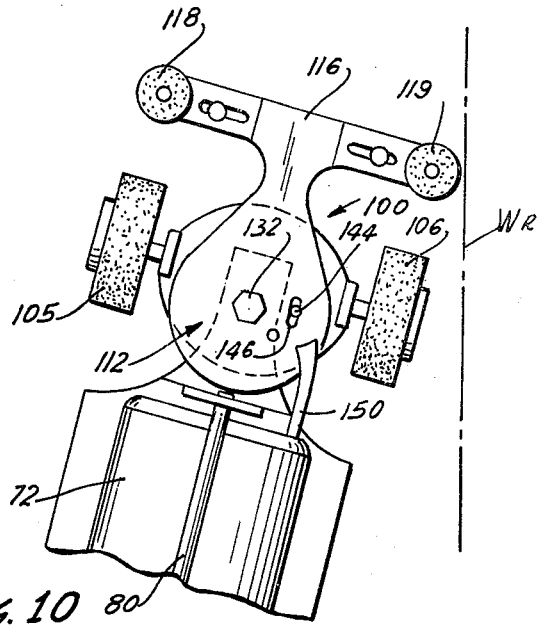
Figure 9:
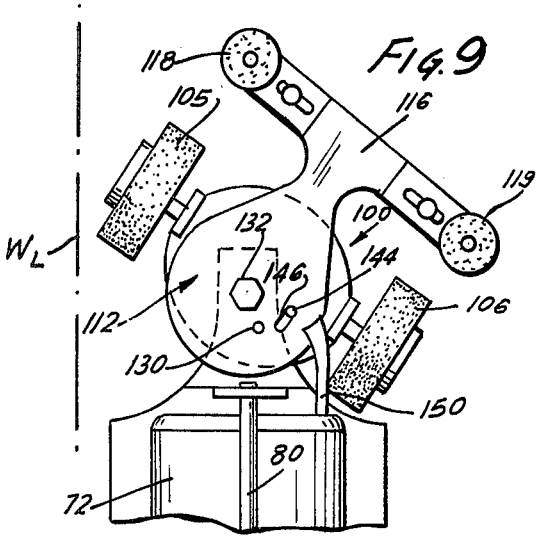
Figure 11:
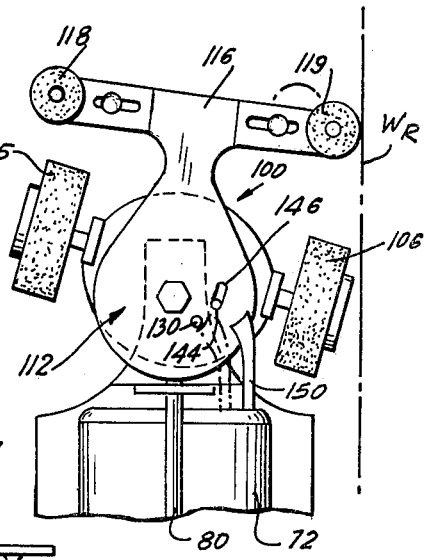

FIG. 8 illustrates the car following a lane of the track adjacent to the side wall $W_1$ at the left. The roller 118 of the positioning member 112 engages the side wall, causing member 112 to rotate clockwise slightly so that pin 144 is moved to the upper end of arcuate slot 146. The front axle becomes almost perpendicular to the track and the car moves straight ahead. The left wheel does not engage the side wall of the track. In this position of member 112, steering post 130 is located so that it is opposite the cam surface 151*b* of the dart whereby upon engagement therewith the post will be moved rearwardly. This happens upon actuation of one of the control switches shown in FIG. 1 to change the current supplied to the motor 72 to produce a current pulse as aforesaid and thus increase the torque is delivered by the motor. The car, of course, has inertia and because of its resistance, the driving wheels acting through the gear train will now cause the motor to move angularly about its pivotal mounting. In the case of the first modification, it will swing about the stem 80; in the case of FIG. 6, it will rotate about its own axis; and in the case of FIG. 7 it will move angularly about the axis of stem 172. Upon the instantaneous increase in torque applied by the motor the cam surface 151*b* is engaged with the post 130 and pivots member 112 in a clockwise direction, as shown in dotted lines in FIG. 8. This causes the axle plate member 100 and the wheels thereon to also pivot clockwise, because of the engagement of pin 144 with the top end of slot 146. Because of axle of wheels 105, 106 is forward of the pivot 132 the wheels have anti-castor effect and, once turned past the dead center direction, will continue to turn in the direction steered. Thus, even though dart 150 returns to its normal position (shown in solid lines) upon reduction of the reduced current pulse, the wheels will continue to turn to the right. FIG. 9 illustrates the configuration of the steering wheels after the dart has engaged post 130, initiated turning of member 112 and returned to its original position. As seen therein both the positioning member 112 and the axle member 100 have been turned in a clockwise direction, with pin 146 remaining engaged with the top of slot 146. As a result of this turning of the front wheels, the car changes lanes moving over to the right hand lane of the track as illustrated in FIG. 10, and plate 112 is shown in its centered position with respect to the vehicle frame. When the right hand roller 119 of positioning member 112 comes into contact with the right hand side wall $W_r$ of the track the positioning member 112 rotates slightly in a counterclockwise direction relative to the axle member 100 so that plate 146 is moved relative to pin 144 until its opposite or bottom end is adjacent the pin as seen in FIG. 11. The car will now proceed along the right hand lane parallel to the right hand guide wall $W_r$ with the axle of the front wheels being almost perpendicular with respect to the track. In this position steering post 130 on positioning member 112, is now positioned opposite the cam face 151*c* on the other side of apex 151*a* on steering dart 150 so that when the dart moves laterally, in response to an increase in current, cam surface 151*c* will engage the steering post and move it forwardly causing plate 112 to pivot counterclockwise. This will happen when a remote control switch is actuated to increase the current supply and correspondingly the torque of the motor again causing the motor itself to be moved angularly as described. This is illustrated in phantom lines in FIG. 11, showing the steering dart in a position with surface 151*c* engaging the steering post 130 to rotate positioning member 112 and, because of the engagement of pin 144 with the bottom of slot 146, axle member 100 in a counterclockwise direction, thus turning the wheels for causing the car to move over to the opposite lane again. Again, because of the anti-castor effect of the wheel axle location, the wheels, once turned past dead center will continue to turn to the left; even when dart 150 returns to its normal position because of the drop off of the reduced current pulse. When the cars change lanes, they move in response to their own momentum decelerating and then accelerating when the power is again applied. In addition, a return spring will be used to aid in returning the motor to its normal position, moving steering dart 150 away from the steering post 130.

From the foregoing it will be observed that simply by operation of the switches 56 and 58 for cars A and B that they may be caused to transfer from one lane to the other at will, and may pass ahead or behind of other cars that may be provided on the track way if desired.

EMBODIMENT OF FIGS. 12–15

FIGS. 12–15 show a modified form of the invention wherein the axle member 100' is made integral with the transverse member 116 carrying the rollers 118 and 119, the transverse member 116 being connected to the main part of axle member 100' by the neck 114. The member 112' formed as a disc, is separate from the part 116. It has a notch 190 in its periphery cooperating with a post 191 upstanding from the front part 67, of the chassis to serve to limit angular movement of the part 112'. A lost motion connection is provided between the parts 100' and 112' comprising the stem 144 standing from the axle member 100', engaging in arcuate slot 146 in member 112'. The steering post 130 is carried by the disc member 112' adjacent to the point 151 of steering dart 150. The parts are carried on the stem or arbor 132 overlying each other with the interposed washers 133 and 134, as in the previous embodiment.

The operation of the present embodiment is illustrated in FIGS. 12, 14 and 15. In the operation, for example, when the roller 118 engages the side wall at the left side of the track, FIG. 12 the axle member 100' is moved clockwise into a position with the front axle normally perpendicular to the track so that the car runs along in a straight line parallel to the left guide wall. At this time, the steering post 130 is in a position relative to the point 151 of the dart 150 so that upon the next movement of the dart, the steering post 130 is moved in a direction to rotate the member 112' clockwise and it moves the axle member 100' with it to turn the front wheels for a turn to the right FIG. 14 towards the other side of the track. FIG. 14 illustrates such a turn to the right having just been made from the left guide wall and the pin 191 being at the end of the arcuate cut-out 190, as shown.

When the car reaches the other side of the track the roller 119 now engages the right hand side wall, FIG. 15 rotating the axle member 100' in a counter-clockwise direction bringing the front axle into an almost perpendicular position relative to the track and the car runs along in a straight line parallel to the right hand side wall. The pin 144 has now been moved to the left end of the arcuate slot 146. The steering post 130 is now in a position relative to the point 151 of dart 150 so that when the dart is now moved, the steering post 130 is moved forwardly so as to turn the member 112' in a counter-clockwise direction, the axle member 100' turning with it so that a left turn is now made and a car proceeds to the other side of the track until the next turning impulse is imparted from the motor 72.

Figure 16A:
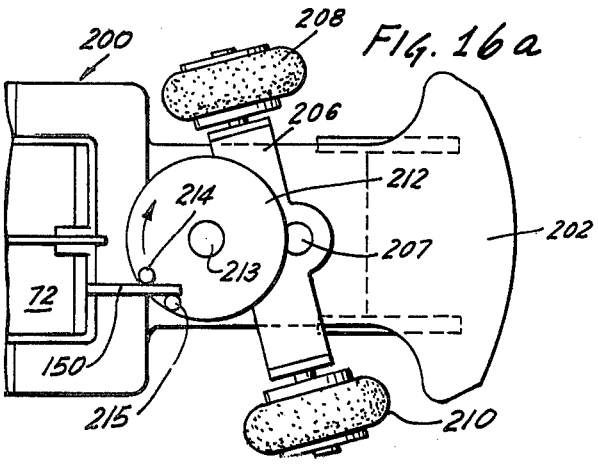
FIG. 16 is a partial schematic plan view illustrating a simplified modified form of the invention.
FIG. 16*b* is a detail view illustrating the steering mechanism of FIG. 16*a*.
FIG. 16*c* is a detail view of the steering cam and FIG. 16*b*.
Figure 16B:
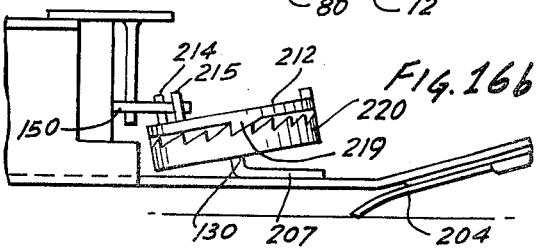
Figure 16C:
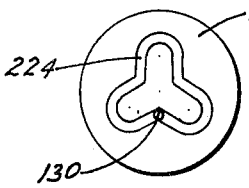

EMBODIMENTS OF FIGS. 16*a*, 16*b* AND 16*c*

FIGS. 16*a*, 16*b* and 16*c* show a modified and simplified form of the invention which does not employ any prepositioning means for the front axle member. In the previous embodiments, normally, while the car is running along adjacent to a side wall the front axle is turned about 5° from normal towards the side wall. The angle of turn of the front axle for turning from one lane to another is normally about 15°. For purposes of the present embodiment, it has been found that the car be operated with the front axle turned at an angle of about 7° from normal towards the side wall with the car running along the side wall. Then, by turning the front axle to a position about 7° from normal in the opposite direction, the car is caused to transfer to the opposite lane and run along the opposite side wall.

In FIGS. 16*a*, 16*b*, and 16*c* the motor is designated at 72 and the dart at 150 as in the previous embodiments. The chassis of the car is designated at 200. The car has a front part designated at 202 which carries collector strips or brushes, one of which is shown at 204. The front axle member is designated at 206 carrying steering post 130 operating about a pivot member 207 and carrying wheels 208 and 210. The steering mechanism includes a disc 212 rotatable about a pivot member 213 and having spaced axial pins 214 and 215, the dart 150 actuatable by the motor being in a position between them as shown. Thus, as may be seen, when the motor is pulsed, the dart 150 will move the disc 212 in angular increments either clockwise and then counterclockwise. The disc 212 carries a pawl 219 which cooperates with the ratchet disc 220 also mounted to rotate about the arbor or pivot 213. Formed in the disc 220 is a slot 224 having a configuration as illustrated in FIG. 16*c*. The steering post 130 fits into the slot 224. As shown, the slot 224 has three lobes although it may have more. Each lobe has two leg parts parallel to radii connected by a curved loop part. As may be seen, incremental angular movement of disc 212 by means of pawl 219 cooperating with the ratchet teeth in disc 220 will move it in angular steps. During each step, the steering post 130 will traverse ½ of one of the lobes of the slot 224. That is, successive steps of the disc 220 will impart reciprocatory movement to the steering post 130. It is positioned on the front axle member 206 to move it angularly to positions about 7° from normal, that is, from perpendicular to the chassis for executing turns from one lane to another as described in the foregoing. The car sequences from a lane at one side to a lane at the other side whenever a turn is imparted to the axle 206 as described. As may be seen, in this embodiment, the car operates without the use of the prepositioning member as previously described.

In a preferred form of the invention, an additional miniature car or drone vehicle is provided on the trackway in addition to those already described, the additional car being identified as a "jam car." It may be of similar construction but constructed, however, to operate at a substantially lower speed. This car may, for example, be battery operated or may be supplied with current directly from the contact strips, in any convenient manner, but it is not remotely steered and ordinarily operates continuously adjacent one side or the other of the trackway due to centrifugal force or fixed canting of the front wheel. This car serves certain distinct purposes in the system. The remotely controlled cars operating at higher speed will catch up to the jam car which then requires that the remotely controlled car be steered around the jam car. The effect of steering around it prevents the remotely controlled cars from being operated continuously at top speed.

In typical remotely controlled systems including slot car systems, if the cars do not leave the track, there is no race. In the system being described, the jam car makes a race out of the system because it runs slower than the remotely controlled cars and it thereby provides a moving obstacle and maintains only one place where one of the two remotely controlled cars can pass. Therefore, one each lap of the race, there is competition between the race cars to see which one will pass the jam car and yet avoid crashing into the jam car. Thus, as may be seen, this concept provides an active and exciting race element operable during each lap in addition to the total race but still there is no need for any car to become disengaged or disconnected from the control system.

Figure 2:
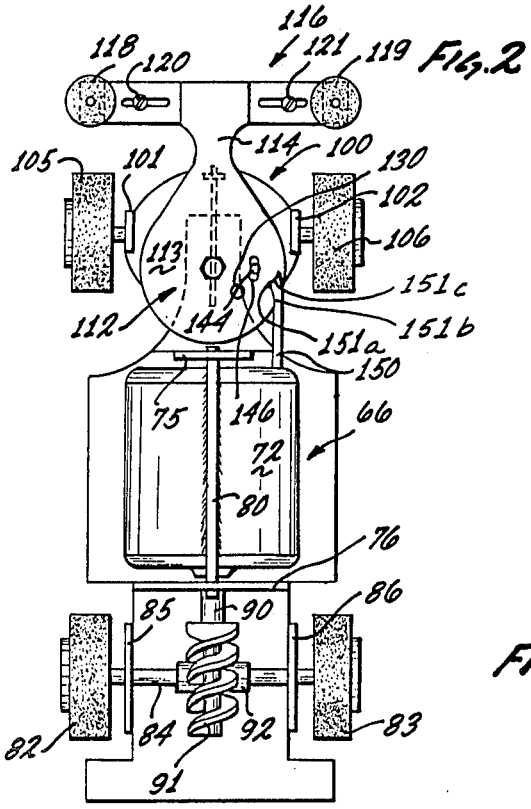
FIG. 2 is a schematic plan view of a preferred form of remote electrically controlled vehicle.
Figure 3:
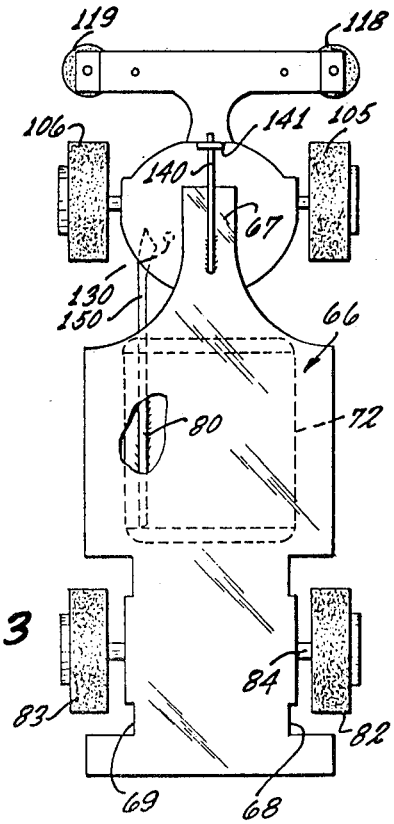
FIG. 3 is a bottom view of the vehicle of FIG. 2.
Figure 4:
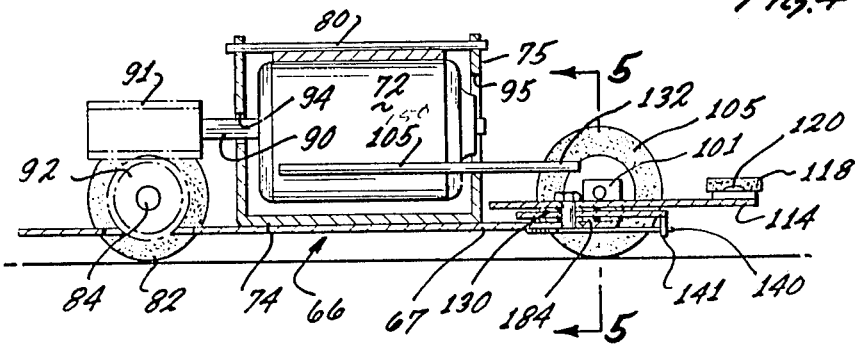
FIG. 4 is a sectional side elevational view of the vehicle of FIGS. 2 and 3.

From the foregoing, those skilled in the art will readily understand the nature of the construction of the car, the steering mechanism, and the manner in which the remote control is effected by varying the torque applied by the motor. It is to be observed that various different modes of suspension of the motor are possible, the steering being similar in each case. The steering mechanism involving the front axle member and the positioning member which resets the steering post relative to the steering dart may take different forms as illustrated in FIGS. 2 and 3 and in FIGS. 12–15.

What is claimed is:

1. A combination comprising an electrically propelled miniature vehicle having a propulsion motor mounted with its shaft in a fore and aft direction, a track for the vehicle having current conductive means, the vehicle having current collectors cooperable with the current conductive means and connected to the vehicle propulsion motor to supply variable current of a single polarity to the motor, remote control means for the vehicle, the vehicle having steering means including at least one steerable wheel turnable about an axis for controlling the direction of movement of the vehicle, the improvement comprising remotely actuated steering means for the vehicle including means for movably mounting the propulsion motor on the chassis such that the reaction of the motor driving torque in response to an increase in current supply to the motor without a change in current polarity acts to tend to physically move the motor in its mounting so that the motor responds to a change in torque; and means including a cam surface mounted for movement with said motor providing a connection between the motor and said steering means whereby steering of the vehicle is effected in response to said change in torque as a result of an increase in current supply to the motor.

2. A combination as in claim 1 wherein said motor is mounted for bodily movement about an axis parallel to and spaced from the axis of the motor.

3. A combination as in claim 1 wherein the propulsion motor is mounted to provide for rotational movement of the motor about its own axis.

4. A combination as in claim 1 including driving means for wheels of the vehicle including a worm gear driven by the propulsion motor and a pinion gear driven by the worm gear.

5. A combination as in claim 1 wherein said steering means includes an axle member turnable about a vertical axis, said connection means including an actuating member carried by the propulsion motor.

6. A combination as in claim 5 wherein said steering means includes a steering post engagable by said cam surface on the propulsion motor.

7. A combination comprising an electrically propelled miniature vehicle, track for the vehicle having current conductive means, the vehicle having current collectors cooperable with the current conductive means and connected to the vehicle propulsion motor, remote control means for the vehicle including means for varying the amount of current supplied to current conductive means without changing the polarity thereof, the vehicle having steering means including at least one steerable wheel turnable about an axis for controlling the direction of movement of the vehicle, the improvement comprising remotely actuated steering means for the vehicle responsive to an increase in current supply to the motor including means for mounting the propulsion motor on the chassis in a manner such that the reaction of the motor driving torque acts to tend to physically move the motor in its mounting in the same direction the motor driving torque tended to move the motor before the increase in current supply so that the motor responds to a change in torque, and means providing a connection between the motor and said steering means whereby steering of the vehicle is effected in response to said change in torque, said steering means including an axle member turnable about a vertical axis, said connection means including an actuating member carried by the propulsion motor, said steering means including a steering post engaged by the actuating member carried by the propulsion motor when the motor moves as a result of increased torque, said steering post being mounted to have fore and aft movement, said actuating member being positionable to engage said steering post for moving it forwardly from its rearward position or rearwardly from its forward position in response to a change in torque.

8. A combination comprising an electrically propelled miniature vehicle, a track for the vehicle having current conductive means, the vehicle having current collectors cooperable with the current conductive means and connected to the vehicle propulsion motor, remote control means for the vehicle, the vehicle having steering means including at least one steerable wheel turnable about an axis for controlling the direction of movement of the vehicle, the improvement comprising remotely actuated steering means for the vehicle, said last means including the propulsion motor being physically mounted on the chassis in a manner such that the reaction of the motor driving torque acts to tend to physically move the motor in its mounting so that the motor responds to a change in torque, and means providing a connection between the motor and the said steering means whereby steering of the vehicle is effected in response to said change in torque, said stearing means including an axle member turnable about a vertical axis, said connection means including an actuating member carried by the propulsion motor, said steering means including a steering post engageable by the member carried by the propulsion motor, said steering post being mounted to have fore and aft movement, said actuating member being positionable whereby to engage said steering post for moving it either forwardly or rearwardly and means for prepositioning said steering post relative to said actuating member, which includes the axle member and a second member, means providing a lost motion connection between said axle member and second member, the steering post being carried by one of said members, the pre-positioning means having a part engagable with a side wall for turning one of said members whereby to position the steering post so that when engaged by the actuating member it is moved in a direction to turn the axle member in a direction away from the side wall.

9. A combination as in claim 8 wherein the steering post is carried by the said second member.

10. A combination as in claim 9 wherein the part engagable with a side wall is integral with the axle member.

11. A combination as in claim 9 wherein the steering post is carried by the axle member.

12. A combination as in claim 9 wherein the second member carries the steering post and has lost motion connections to axle member.

13. In a miniature vehicle of the type having a chassis, at least one driving wheel, at least one steering wheel and a driving motor for driving the driving wheel, said motor being mounted with its shaft parallel to the length of the vehicle, wherein the improvement comprises means for mounting the motor to permit angular movement of the motor about an axis in response to the torque developed by a current pulse of single unvariable polarity and of increased current supplied to the motor, and control means operatively associating the motor and said steering wheel for turning the steering wheel from one steering direction to an opposite steering direction in response to angular movement of the motor about the axis in response to said increased current pulse of unchanged polarity.

14. A vehicle as in claim 13 wherein the motor is mounted for angular movement about an axis which is parallel to the axis of the motor.

15. A vehicle as in claim 13, wherein the motor is mounted for angular movement about its own axis.

16. A combination for electrically operating miniature vehicles along a predetermined path and having means for remotely controlling each vehicle to steer the vehicle, each vehicle having a driving motor, a driving wheel, and steering means, a track for the vehicles having plural lanes and lateral spaced walls defining said lanes, said steering means having two extreme steering positions, one for a left turn and one for a right turn, control means responsive to electrical pulses of the same polarity for positioning said steering means in one of the two extreme steering positions, whereby the vehicles run along adjacent to one or the other of the side walls, said driving motor being mounted for physical angular movement about an axis in response to electrical pulses of the same polarity, said control means being operatively connected between the motor and the steering means to move the steering means from one extreme steering position to the other in response to an electrical pulse of the same polarity as the current previously supplied to the motor.

17. A combination for electrically operating miniature vehicles along a predetermined path, and having means for remotely controlling each vehicle whereby to turn the vehicle, each vehicle having a driving motor, a driving wheel, and a steering means, a track for the vehicles having plural lanes and lateral walls, the steering means having two extreme steering positions, one for a left turn and one for a right turn, control means responsive to electrical pulses for positioning said steering means in one of the two positions, the vehicles being so constructed as to run along adjacent to one or the other of the side walls when the said steering means is in either one of the two positions, the driving motor being mounted for physical movement in response to electrical pulses and the means providing connections between the motor in response to an electrical pulse moves the steering means to one position from the other position, said steering means including a steering post movable between two positions, a rotor cam having engagement with the steering post whereby angular movement of the rotor cam moves the steering post between the two positions, and said connections being constructed whereby physical movement of the driving motor moves the motor cam in angular steps.

18. In a combination for electrically operating miniature vehicles along a predetermined path and having means for remotely controlling individual vehicles whereby to turn the vehicle, each vehicle having a driving motor, a driving wheel and steering means, a track for the vehicles having plural lanes with lateral walls, control means responsive to electrical pulses for positioning the steering means in one of two positions for a left turn or a right turn, the control means including mechanism whereby an electrical pulse can position the steering means for either left or right turn, said mechanism including a guiding member carried by the vehicle in a position to engage a lateral side wall, the guiding member having a relationship with the steering means to be actuated for either a left turn or a right turn in response to an electrical pulse; said steering means including a steering post positioned to be engaged for making a right or left hand turn, and connections between said guiding member and said steering post whereby the guiding member positions the steering post for being actuated for either a right or left turn, said steering post being carried by a part of said guiding member.

19. A combination as in claim 18 including connections between the steering post means and the steering means.

20. A combination including a plurality of electrically powered controllable vehicles having propulsion motors, and at least one uncontrolled toy vehicle, a slotless track for the vehicles having current conductive means, said uncontrolled vehicle including means therein for driving it about the track at a relatively constant speed, said controllable vehicles having current collectors cooperable with the current conductive means and connected to the vehicle propulsion motors of said controllable vehicles, remote control means for said controllable vehicles only, said controllable vehicles having steering means for controlling the direction of motion of the controllable vehicles, said steering means including means responsive to electrical pulses of unchanging polarity transmitted through said remote means for causing the controllable vehicles to overtake and pass said uncontrolled vehicle operating on the track.

21. In a system embodying miniature electrically operated miniature vehicles which are remotely controlled, the system including a track for the vehicles having plural lanes and lateral walls and the vehicles being steerable to turn from a position adjacent one side wall to a position adjacent an opposite wall, a method of creating a race including the step of operating one additional obstacle vehicle on the track at an uncontrolled lower relatively constant speed than the other vehicles, and remotely controlling the other vehicles to steer around and pass said one vehicle whereby the controlled vehicles are restricted to passing the obstacle vehicle one at a time at a random time and location around the track circuit.

22. A toy vehicle game including a track, a plurality of controllable powered toy vehicles for use on said track, and at least one obstacle toy vehicle which is uncontrolled while on the track including means for driving the obstacle vehicle about the track at a relatively constant speed and separate means for driving the controllable powered toy vehicles along said track at variable controlled speeds and for changing the lateral position of said controllable powered toy vehicles on the track to enable said controllable vehicles to pass said at least one obstacle vehicle.

23. A toy vehicle game including a guide track and a plurality of controllable toy vehicles and at least one obstacle toy vehicle which is uncontrolled while on the said guide track having a width of sufficient dimension to define two vehicle lanes enabling two vehicles to move along the track in side by side relation; said obstacle toy vehicle including means for driving the obstacle vehicle along the track at a relatively constant speed; and said controllable toy vehicles including means for driving the controllable toy vehicles along said track at variable controlled speeds and for causing said controllable vehicles to switch lanes to enable said controllable vehicles to pass said obstacle vehicle.

* * * * *